United States Patent [19]

Przybylek et al.

[11] 4,044,275

[45] Aug. 23, 1977

[54] DISPLAY PANEL HAVING IMPROVED MERCURY ASSEMBLY

[75] Inventors: George John Przybylek, Warren; Joseph Lesky, Cranford, both of N.J.

[73] Assignee: Burroughs Corporation, Detroit, Mich.

[21] Appl. No.: 739,986

[22] Filed: Nov. 8, 1976

[51] Int. Cl.[2] ..... H01J 61/12; H01J 61/36

[52] U.S. Cl. ..... 313/177; 313/220

[58] Field of Search ..... 313/174, 177, 220

[56] References Cited

U.S. PATENT DOCUMENTS

| | | | |
|---|---|---|---|
| 1,768,421 | 6/1930 | Ruggles | 313/177 |
| 3,944,869 | 3/1976 | Przybylek | 313/220 X |
| 4,009,407 | 2/1977 | Kupsky | 313/177 |

*Primary Examiner*—Palmer C. Demeo

*Attorney, Agent, or Firm*—Kevin R. Peterson; Robert A. Green; Edward J. Feeney, Jr.

[57] ABSTRACT

The panel comprises a gas-filled envelope formed by a base plate and a face plate hermetically sealed together by a ring of fusible sealing material. The interior of the envelope includes a display area which consists of glow cathodes and one or more anodes. Adjacent to the display area and near one end of the panel is provided a source of mercury which comprises a glass capillary tube containing a droplet of mercury. The mercury capillary tube is supported by a generally C-shaped insulating layer which is formed when the ring of fusible sealing material is formed, and of the same material. This C-shaped layer, like the sealing ring, is in contact with, and lies between, the base plate and face plate. The glass capillary is embedded at one end and at about its midpoint in this seal material, with the opposite end being free and unsupported. The free end of the capillary can be shattered by a laser to release mercury vapor into the panel envelope. The small spacing between the capillary and both the base plate and face plate prevents mercury droplets held inside the C-shaped layer from entering the display area of the panel, and, after the initial opening of the capillary, during which droplets might appear, no further droplets will leave the capillary, due to capillary adhesion, and only mercury vapor will be emitted.

3 Claims, 2 Drawing Figures

DISPLAY PANEL HAVING IMPROVED MERCURY ASSEMBLY

BACKGROUND OF THE INVENTION

In display panels such as PANAPLEX panels used in the prior art, mercury is provided in the gas atmosphere to minimize cathode sputtering, and the mercury is provided either in a capsule mounted in the panel tubulation, or it is provided in a metal capsule disposed at an end of the panel within the envelope. Both arrangements work well, but they are unsatisfactory because the capsules which are required are relatively expensive.

The present invention permits the utilization of an inexpensive mercury capsule and a barrier support therefor which can be formed simply and inexpensively.

DESCRIPTION OF THE PREFERRED EMBODIMENTS

Figure 1:
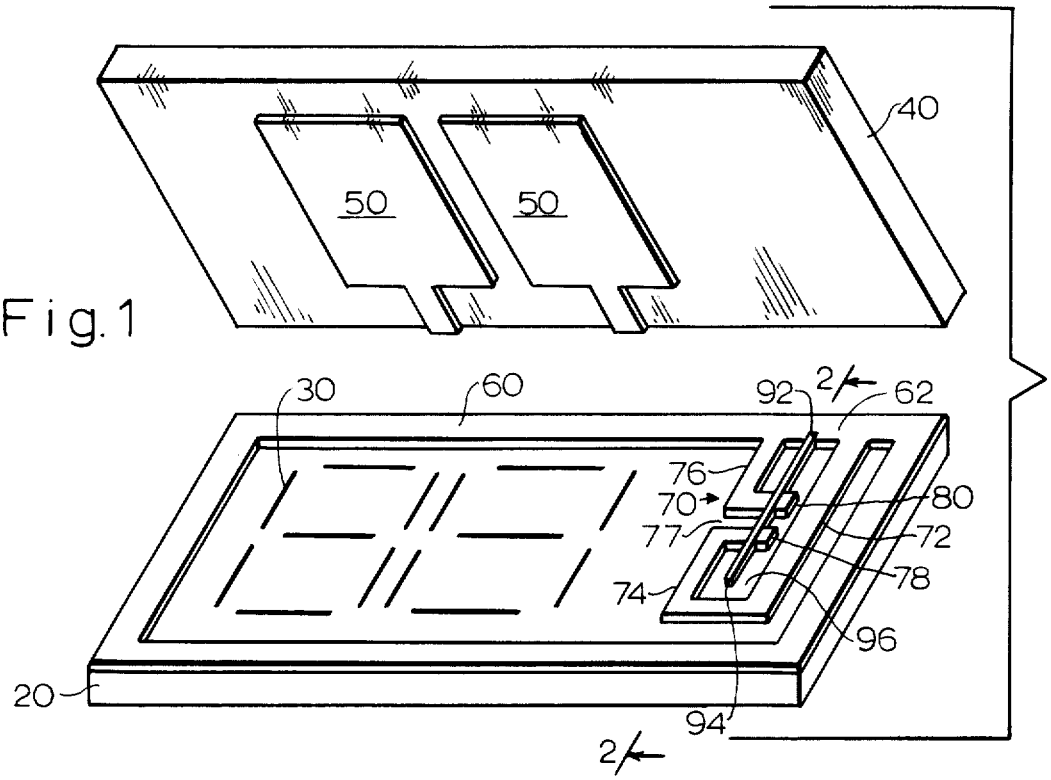
FIG. 1 is a perspective exploded view of a display panel embodying the invention.

The principles of the invention are described herein with respect to a display panel of the type known as a PANAPLEX panel as shown and described in U.S. Pat. Nos. 3,868,535 and 3,944,869, which are incorporated herein by reference. However, it will be clear to those skilled in the art that the principles of the invention are applicable to other types of display panels which use mercury capsules or capsules containing other materials to be released into an atmosphere in a closed container.

A typical PANAPLEX display panel 10 includes a glass base plate 20 having a plurality of groups of cathode electrodes 30 formed on its inner top surface and forming a display area, with corresponding cathodes being connected to common conductors and common terminals, not shown here, but shown in U.S. Pat. No. 3,868,535. An insulating layer (not shown) is provided covering the leads from the cathodes and the common conductors so that these leads and conductors will not glow and only the cathodes glow. These features are well known and need not be shown here. The panel 10 includes a face plate 40 which is spaced from the base plate and carries a transparent conductive anode electrode 50 overlying each group of cathode electrodes 30. The base plate and face plate are sealed together with the desired spacing between them by means of a ring 60 of fusible insulating material which is formed, preferably, on the base plate by a screening process. In manufacturing the panel 10, after the sealing ring 60 has been formed and any other necessary procedural steps are carried out, the base plate and face plate are assembled in the desired orientation and the ring 60 is suitably heated to form the desired hermetic seal between the base plate and face plate.

According to the invention, when the sealing ring 60 is screened on the base plate, a generally C-shaped or U-shaped portion 70 is formed, preferably out of the display area of the panel. This C-shaped portion includes a vertical leg 72, which extends, for example, from the upper edge of the base plate toward the lower edge, and two C-shaped legs 74 and 76 which extend toward each other and terminate with a small space 77 between them. The adjacent ends of the legs 74 and 76 include parallel legs 78 and 80 which are turned inwardly toward the vertical leg 72 of the "C".

Figure 2:
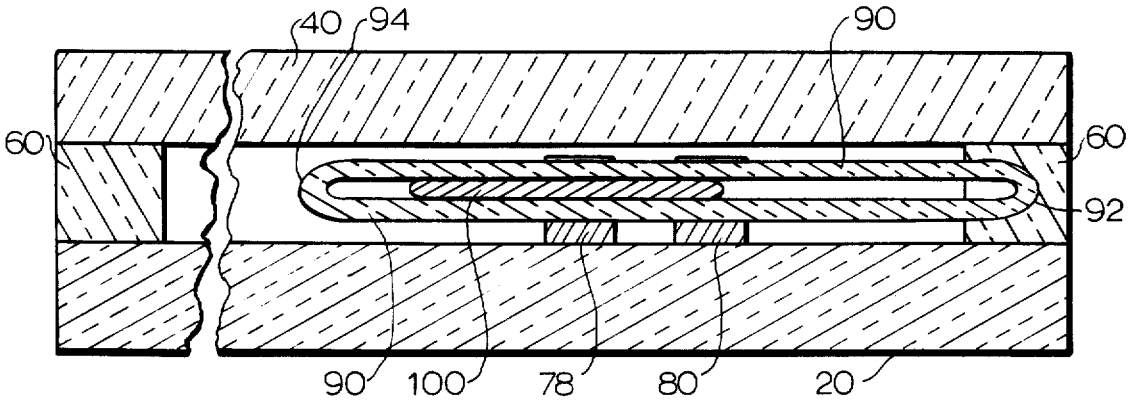
FIG. 2 is a sectional view, along the lines 2—2, in FIG. 1 showing the panel assembled.

When the sealing ring 60 and the C-shaped portion 70 are formed and while they are still in a viscous state, a glass capillary 90 containing the desired quantity of mercury 100 is disposed across the C-shaped portion so that one end 92 is at least partially embedded in the portion 62 of the sealing ring 60, an intermediate portion of the capillary is at least partially embedded in the two horizontal turned-in legs 78 and 80, and the other end 94 of the capillary lies free and unsupported. This end 94 of the capillary is accessible to be broken by an energy source disposed outside the panel. The capillary is depressed a suitable distance into the C-shaped portion of sealing material, as illustrated in FIG. 2. It is noted that capillary tube 90 is disposed within the area defined by C-shaped member 70.

It is noted that the sealing ring 60 and C-shaped portion 70 might be formed on the face plate 40, if desired. The capillary 90 would be supported as described above.

In assembling and processing the panel 10, after the base plate and face plate have been suitably processed, the required electrodes have been formed thereon, and the sealing ring 60 and C-shaped portion 70 and mercury capillary 90 have been formed and assembled, the base plate and face plate are put together and inserted in a furnace in which the panel can be evacuated, baked out, filled with the desired gas, and heated to a temperature at which the sealing material fuses and, on cooling, forms the desired hermetic seal. These steps need not be performed in the order stated, and they are well known in the art.

After the panel has been thus assembled, a laser or other means is used to shatter the free end 94 of the mercury capillary. When this is done, a small piece of glass, from the capillary, falls into the area 96 of the C-shaped portion of the sealing material in which the free end of the capillary is located, and a small droplet of mercury may also fall into this area. However, the small spacing between the capillary 90 and both the base plate and face plate (FIG. 2), a distance of a few mils, prevents the glass or the mercury droplet from falling through the space 77 and entering the display portion of the panel. However, mercury vapor will flow through this space 77 into the display area of the panel. In addition, as the panel is operated and as time passes, mercury vapor will diffuse out of the capillary into the panel where it will perform its desired function.

What is claimed is:

1. A display panel comprising a gas-filled envelope made up of a base plate and a face plate hermetically sealed together, said face plate having a viewing window, at least one glow cathode and an anode in said envelope disposed in a display area in said envelope, a generally C-shaped body of insulating material disposed within said envelope between said base plate and face plate, said C-shaped body including a base and a pair of closely-spaced legs, there being a relatively narrow gas flow path between said legs, and a glass capillary tube containing a vaporizable substance to be admitted to said panel, said capillary tube extending across said C-shaped body, disposed within the area defined by said C-shaped body, and having one end embedded in said C-shaped body and the other end unsupported and shatterable by means external to said panel, the vapor of said substance, but not glass particles or globules of said substance, being able to diffuse into said display area through said space between said legs of said C-shaped member.

2. The panel defined in claim 1 wherein said C-shaped body comprises an extension of the material which forms the hermetic seal between said base plate and face plate.

3. A display panel comprising a gas-filled envelope made up of a base plate and a face plate hermetically sealed together, said face plate having a viewing window, at least one glow cathode and an anode in said envelope disposed in a display area in said envelope, a ring of sealing material disposed along the aligned perimeters of said base plate and forming the hermetic seal therebetween and including a generally C-shaped portion extending into the interior of said panel and disposed between said base plate and face plate, said C-shaped body including a base and a pair of closely spaced legs, there being a relatively narrow gas flow path between said legs, and a glass capillary tube containing a substance to be admitted to said panel and having one end embedded in said C-shaped body and the other end unsupported and shatterable by means external to said panel, the vapor of said substance, but not glass particles or globules of said substance, being able to diffuse into said display area through said space between said legs of said C-shaped member.

* * * * *